US007457746B2

(12) United States Patent
Gao

(10) Patent No.: US 7,457,746 B2
(45) Date of Patent: Nov. 25, 2008

(54) PITCH PREDICTION FOR PACKET LOSS CONCEALMENT

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 385 days.

(21) Appl. No.: 11/385,432

(22) Filed: Mar. 20, 2006

(65) Prior Publication Data

US 2007/0219788 A1 Sep. 20, 2007

(51) Int. Cl.
*G10L 19/04* (2006.01)

(52) U.S. Cl. ..... 704/219; 704/207; 704/208; 704/217

(58) Field of Classification Search ..... 704/219, 704/217, 207, 208
See application file for complete search history.

(56) References Cited

U.S. PATENT DOCUMENTS 5,105,464 A * 4/1992 Zinser ..... 704/219
5,451,951 A * 9/1995 Elliott et al. ..... 341/155
5,884,010 A * 3/1999 Chen et al. ..... 704/228
2002/0091523 A1* 7/2002 Makinen et al. ..... 704/258
2006/0265216 A1* 11/2006 Chen ..... 704/228

OTHER PUBLICATIONS

*Coding of Speech at 8 kbit/s Using Conjugate-Structure Algebraic-Code-Excited Linear-Prediction (CS-ACELP)*, International Telecommunication Union, ITU-T Recommendation G.729, 1-35 (Mar. 1996).

* cited by examiner

*Primary Examiner*—Qi Han
(74) *Attorney, Agent, or Firm*—Farjami & Farjami LLP

(57) ABSTRACT

There is provided a pitch lag predictor for use by a speech decoder to generate a predicted pitch lag parameter. The pitch lag predictor comprises a summation calculator configured to generate a first summation based on a plurality of previous pitch lag parameters, and a second summation based on a plurality of previous pitch lag parameters and a position of each of the plurality of previous pitch lag parameters with respect to the predicted pitch lag parameter; a coefficient calculator configured to generate a first coefficient using a first equation based on the first summation and the second summation, and a second coefficient using a second equation based on the first summation and the second summation, wherein the first equation is different than the second equation; and a predictor configured to generate the predicted pitch lag parameter based on the first coefficient and the second coefficient.

4 Claims, 3 Drawing Sheets

PITCH PREDICTION FOR PACKET LOSS CONCEALMENT

BACKGROUND OF THE INVENTION

1. Field of the Invention

The present invention relates generally to speech coding. More particularly, the present invention relates to pitch prediction for concealing lost packets.

2. Background Art

Subscribers use speech quality as the benchmark for assessing the overall quality of a telephone network. Gateway VoIP (Voice over Internet Protocol or Packet Network) devices, which are placed at the edge of the packet network, perform the task of encoding speech signals (speech compression), packetizing the encoded speech into data packets, and transmitting the data packets over the packet network to remote VoIP devices. Conversely, such remote VoIP devices perform the task of receiving the data packets over the packet network, depacketizing the data packets to retrieve the encoded speech and decoding (speech decompression) the encoded speech to regenerate the original speech signals.

Packet loss over the packet network is a major source of speech impairments in VoIP applications. Such loss could be caused for a variety of reasons, such as discarding packets in the packet network due to congestion or by dropping packets at the gateway due to late arrival. Of course, packet loss can have a substantial impact on perceived speech quality. In modern codecs, concealment algorithms are used to alleviate the effects of packet loss on perceived speech quality. For example, when a loss occurs, the speech decoder derives the parameters for the lost frame from the parameters of previous frames to conceal the loss. The loss also affects the subsequent frames, because the decoder takes a finite time to resynchronize its state to that of the encoder. Recent research has shown that for some codecs (e.g. G.729) packet loss concealment (PLC) works well for a single frame loss, but not for consecutive or burst losses. Further, the effectiveness of a concealment algorithm is affected by which part of speech is lost (e.g. voiced or unvoiced). For example, it has been shown that concealment for G.729 works well for unvoiced frames, but not for voiced frames.

When a packet loss occurs, one of the most important parameters to be recovered or reconstructed is the pitch lag parameter, which represents the fundamental frequency of the speech (active-voice) signal. Traditional packet loss algorithms copy or duplicate the previous pitch lag parameter for the lost frame or constantly add one (1) to the immediately previous pitch lag parameter. In other words, if a number of frames have been lost, all the lost frames use the same pitch lag parameter from the last good frame, or the first frame duplicates the pitch lag parameter from the last good frame, and each subsequent lost frame adds one (1) to its immediately previous pitch lag parameter, which has itself been reconstructed.

FIG. 1 illustrates a conventional approach for pitch lag prediction used by conventional packet loss concealment algorithms. As shown, pitch lags 120-129 show the true pitch lags on pitch track 110. FIG. 1 also shows a situation where a number of frames have been lost due to packet loss. Conventional pitch lag prediction algorithms duplicate or copy the pitch lag parameter from the last good frame, i.e. pitch lag 125 is copied as pitch lag 130 for the first lost frame. Further, pitch lag 130 is copied as pitch lag 131 for the next lost frame, which is then copied as pitch lag 132 for the next lost frame, and so on. As a result, it can been seen from FIG. 1 that pitch lags 130-132 fall considerably outside of pitch track 130, and there is a considerable distance or gap between the next good pitch lag 129 and reconstructed pitch lag 132, when compared to the distance between lost pitch lag 128 and pitch lag 129. Although, pitch lags 130-132 are the same as pitch lag 125 and do not create a perceptible difference for a listener at that juncture, but the considerable distance gap between reconstructed pitch lag 132 and pitch lag 129 creates a click sound that is perceptually very unpleasant to the listener.

Accordingly, there is a strong need in the art to for packet loss concealment systems and methods, which can offer a superior speech quality by efficiently predicting the pitch lags for lost frames that are more in line with the pitch track.

SUMMARY OF THE INVENTION

The present invention is directed to a pitch lag predictor for use by a speech decoder to generate a predicted pitch lag parameter. In one aspect, the pitch lag predictor comprises a summation calculator configured to generate a first summation based on a plurality of previous pitch lag parameters, and further configured to generate a second summation based on a plurality of previous pitch lag parameters and a position of each of the plurality of previous pitch lag parameters with respect to the predicted pitch lag parameter. Further, the pitch lag predictor comprises a coefficient calculator configured to generate a first coefficient using a first equation based on the first summation and the second summation, and further configured to generate a second coefficient using a second equation based on the first summation and the second summation, wherein the first equation is different than the second equation; and a predictor configured to generate the predicted pitch lag parameter based on the first coefficient and the second coefficient.

In another aspect, the predictor generates the predicted pitch lag parameter by (the first coefficient+the second coefficient*n). In a further aspect, the first summation is defined by $$\text{sum0} = \sum_{i=0}^{n-1} P(i),$$

and the second summation is defined by $$\text{sum1} = \sum_{i=0}^{n-1} i * P(i),$$

where n is the number of the plurality of previous pitch lag parameters. In a related aspect, the first equation is defined by a=(3*sum0−sum1)/5, and the second equation is defined by b=(sum1−2*sum0)/10, where the predictor generates the predicted pitch lag parameter by (the first coefficient+the second coefficient*n), and where the first equation and the second equation are obtained by setting $$\frac{\partial E}{\partial a} \text{ and } \frac{\partial E}{\partial b}$$

to zero, where:

$$E = \sum_{i=0}^{n-1} [(P'(i) - P(i)]^2 = \sum_{i=0}^{n-1} [(a + b * i) - P(i)]^2.$$

In a separate aspect, there is provided a pitch lag predictor for use by a speech decoder to generate a predicted pitch lag parameter. The pitch lag predictor comprises a coefficient calculator configured to generate a first coefficient using a first equation based on a plurality of previous pitch lag parameters, and further configured to generate a second coefficient using a second equation based on the plurality of previous pitch lag parameters; and a predictor configured to generate the predicted pitch lag parameter based on the first coefficient and the second coefficient.

In an additional aspect, the first equation is defined by a=(3*sum0−sum1)/5, and the second equation is defined by b=(sum1−2*sum0)/10, wherein $$\text{sum0} = \sum_{i=0}^{n-1} P(i) \text{ and } \text{sum1} = \sum_{i=0}^{n-1} i * P(i),$$

where n is the number of the plurality of previous pitch lag parameters, and the predictor generates the predicted pitch lag parameter by (the first coefficient+the second coefficient*n).

Other features and advantages of the present invention will become more readily apparent to those of ordinary skill in the art after reviewing the following detailed description and accompanying drawings.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1:
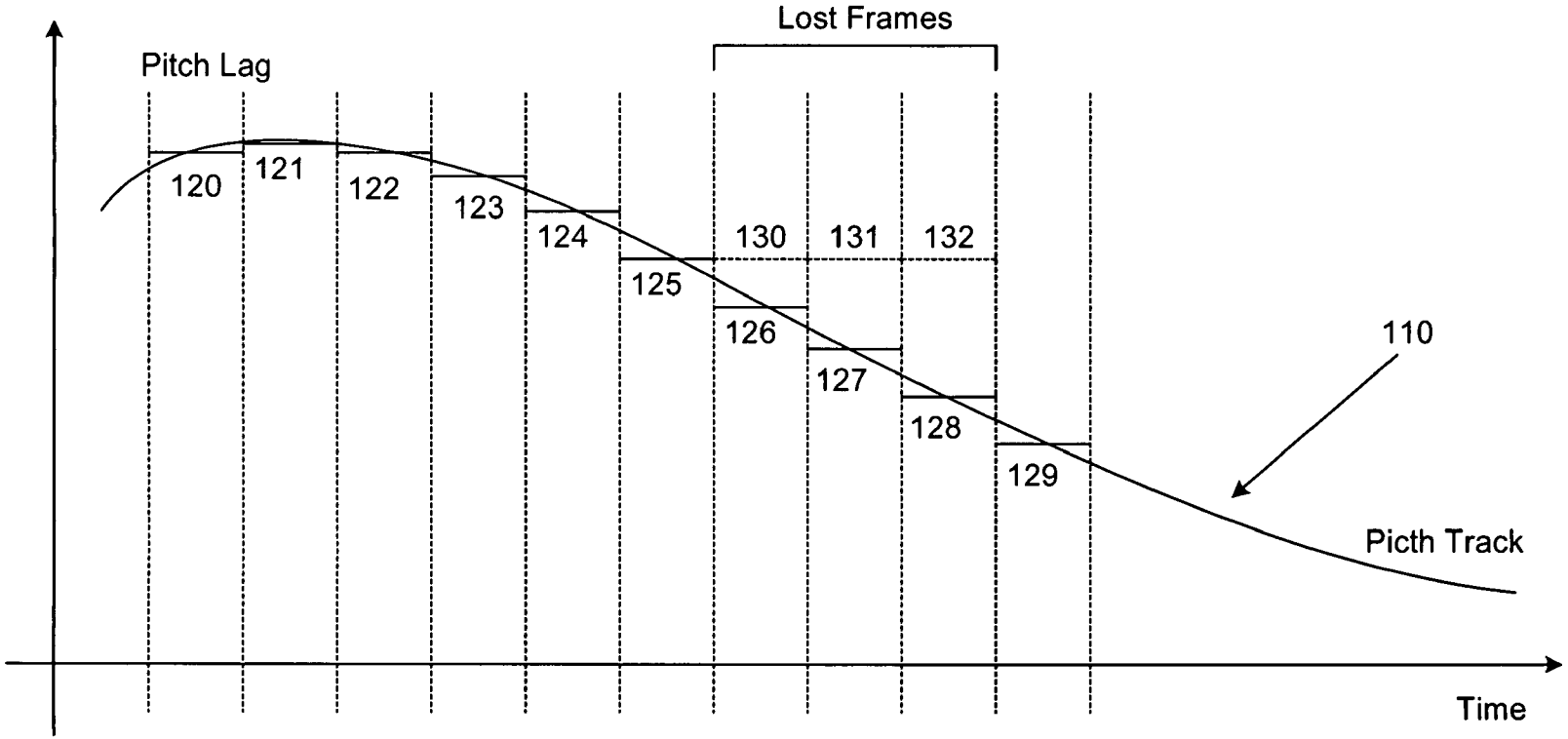
FIG. 1 (PRIOR ART)
FIG. 1 illustrates a pitch track diagram with lost packets or frames, and an application of a conventional pitch prediction algorithm for reconstructing lost pitch lag parameters for the lost frames.

Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

Figure 2:
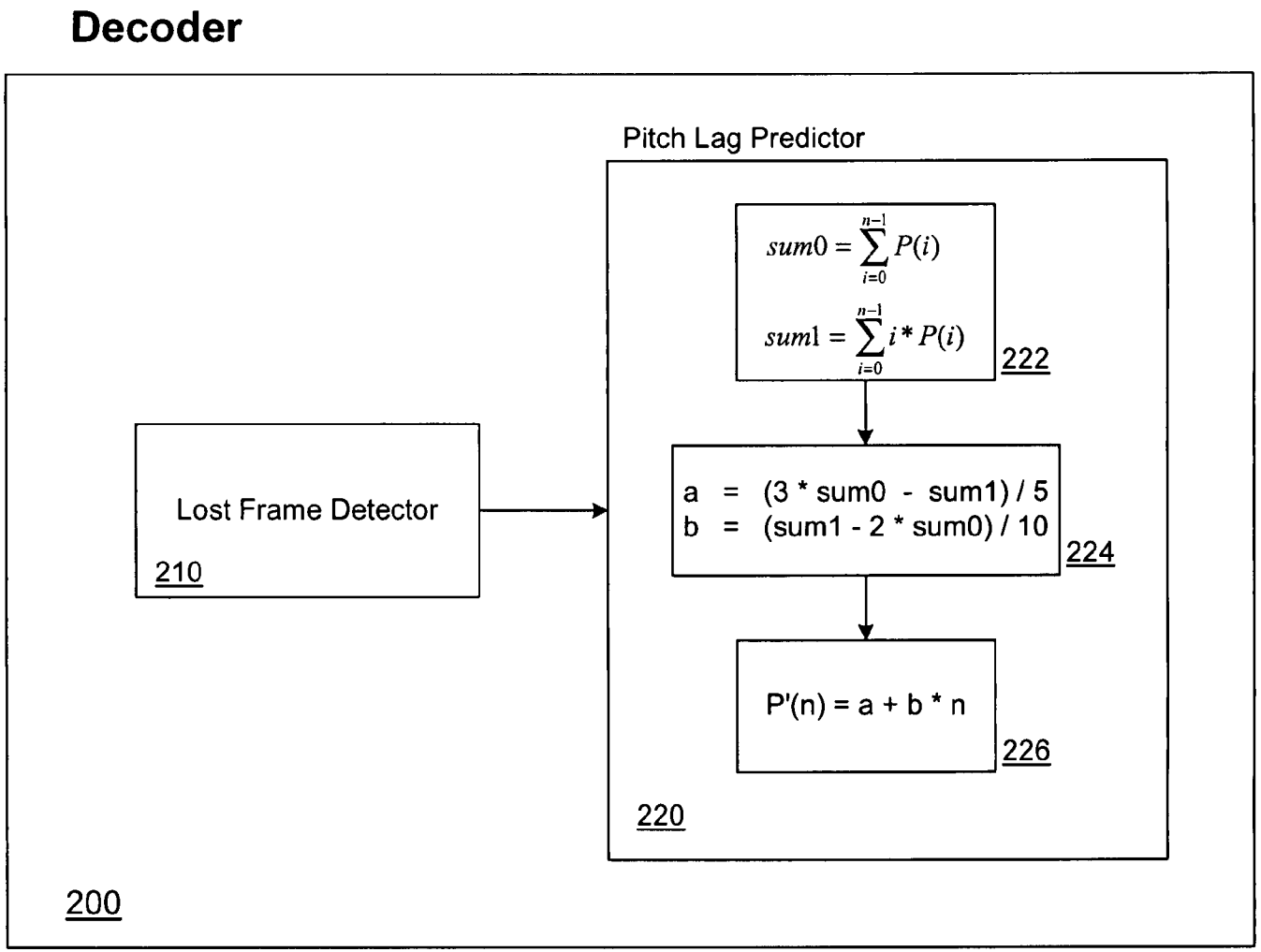
FIG. 2 illustrates a decoder including a pitch lag predictor, according to one embodiment of the present application.

FIG. 2 illustrates decoder 200, including lost frame detector 210 and pitch lag predictor 220 for detecting lost frames and reconstructing lost pitch lag parameters for the lost frames. Unlike conventional pitch lag predictors, pitch lag predictor 220 of the present invention predicts lost pitch lags based on a plurality of previous pitch lag parameters. The pitch lag prediction model based on a plurality of previous pitch lag parameters may be linear or non-linear. In one embodiment of the present invention, a linear pitch prediction model, which uses (n) previous pitch lag parameters, is designated by:

$$P(i), \text{ where } i=0, 1, 2, 3, \ldots n-1, \qquad \text{Equation 1.}$$

In one embodiment, (n) may be 5, where P(0) is the earliest pitch lag and P(4) is the immediate previous pitch lag, and the predicted pitch lag may be defined by:

$$P'(n)=a+b*n, \qquad \text{Equation 2.}$$

Coefficients a and b may be determined by minimizing the error E by setting $$\frac{\partial E}{\partial a} \text{ and } \frac{\partial E}{\partial b}$$

to zero (0), where:

$$E = \sum_{i=0}^{n-1} [(P'(i) - P(i)]^2 = \sum_{i=0}^{n-1} [(a + b * i) - P(i)]^2. \qquad \text{Equation 3}$$

The minimization of error E results in the following values for coefficients a and b:

$$a=(3*\text{sum0}-\text{sum1})/5, \qquad \text{Equation 4,}$$

$$b=(\text{sum1}-2*\text{sum0})/10; \qquad \text{Equation 5.}$$

Where, $$\text{sum0} = \sum_{i=0}^{n-1} P(i), , \qquad \text{Equation 6}$$

$$\text{sum1} = \sum_{i=0}^{n-1} i * P(i), . \qquad \text{Equation 7}$$

For example, where in one embodiment (n) is set to five (5), then a predicted pitch lag (or P'(5)=a+b*5) is calculated by obtaining the values of sum0 and sum1 from equations 6 and 7, respectively, and then deriving coefficients a and b based sum0 and sum1 for defining P'(5). Appendices A and B show an implementation of a pitch prediction algorithm of the present invention using "C" programming language in fixed-point and floating-point, respectively.

Turning to FIG. 2, lost frame detector 210 of decoder 200 detects lost frames and invokes pitch lag predictor 220 to predict a pitch lag parameter for a lost frame. In response, pitch lag predictor 220 calculates the values of sum0 and sum1, according to equations 6 and 7, at summation calculator 222. Next, pitch lag predictor 220 uses the values of sum0 and sum1 to obtain coefficients a and b, according to equations 4 and 5, at coefficients calculator 224. Next, predictor 226 predicts the lost pitch lag parameter based on a plurality of previous pitch lag parameters according to equation 2.

Figure 3:
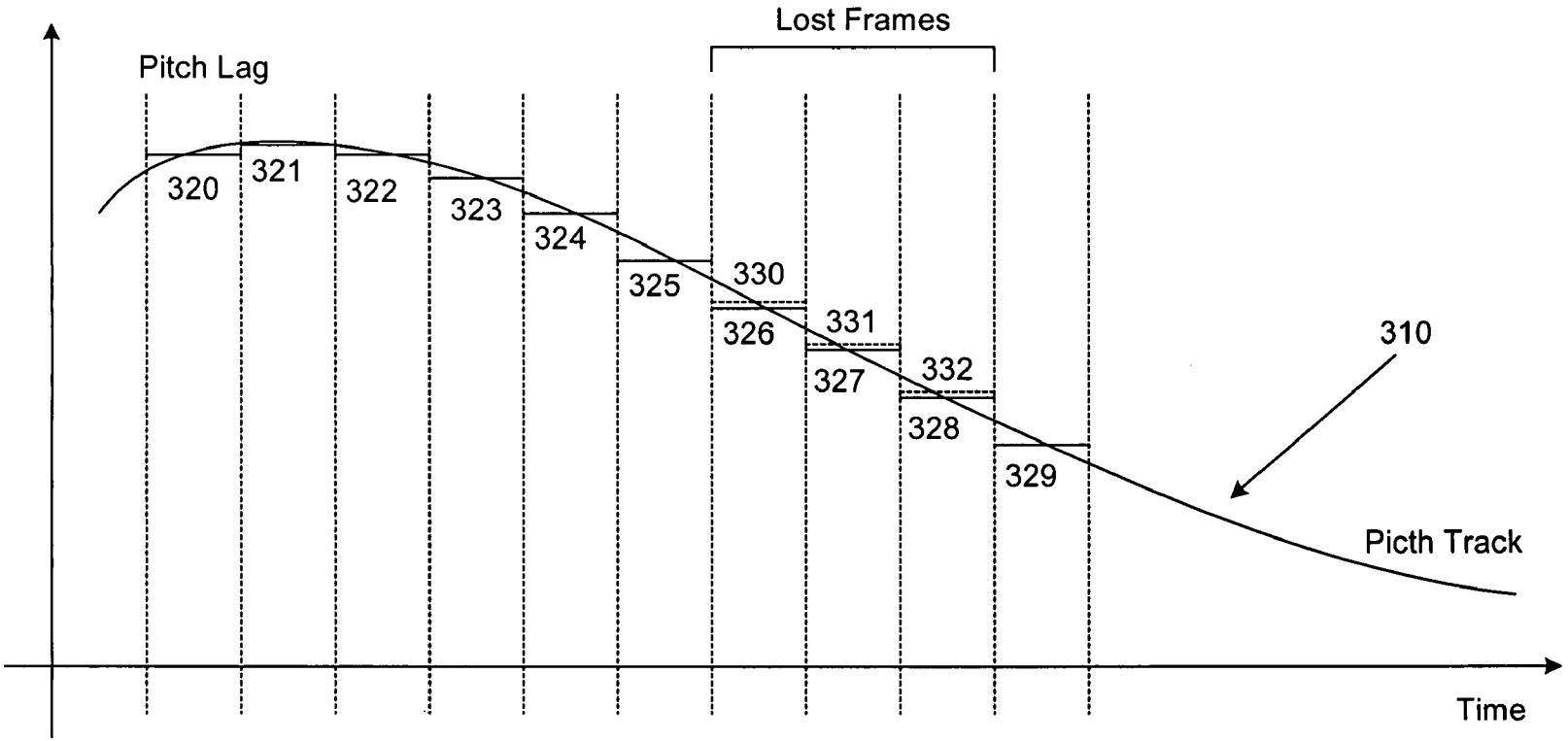
FIG. 3 illustrates a pitch track diagram with lost packets or frames, and an application of the pitch lag predictor of FIG. 2 for reconstructing lost pitch lag parameters for the lost frames.

FIG. 3 illustrates a pitch track diagram with lost packets or frames, and an application of the pitch lag predictor of the present invention for reconstructing lost pitch lag parameters for the lost frames. As shown, in contrast to conventional pitch prediction algorithms, pitch lag predictor 200 of the present invention predicts pitch lags 330, 331 and 331 based on a plurality of previous pitch lags and obtains pitch lag parameters that are closer to the true pitch lag parameters of the lost frames. For example, in an embodiment where (n) is five (5), pitch lag 330 is calculated based on pitch lags 321, 322, 323, 324 and 325; pitch lag 331 is calculated based on pitch lags 322, 323, 324, 325 and 330; and pitch lag 332 is calculated based on pitch lags 323, 324, 325, 330 and 331. As a result, the distance or the gap between pitch lag 332 and 329 is substantially reduced and the perceptual quality of the decoded speech signal is considerably improved.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. For example, it is contemplated that the circuitry disclosed herein can be implemented in software, or vice versa. The described embodiments are to be considered in all respects as illustrative and not restrictive. It should also be understood that the invention is not limited to the particular embodiments described herein, but is capable of many rearrangements, modifications, and substitutions without departing from the scope of the invention.

APPENDIX A

```
/*****************************************************************************/
/*****************************************************************************/
/*                                Fixed-Point Pitch Prediction                 */
/*****************************************************************************/
/*****************************************************************************/
/*-----------------------------------------------------------------*
 *    Pitch prediction for frame erasure                           *
 *-----------------------------------------------------------------*/
#define PIT_MAX32  (Word16)(G729EV_G729_PIT_MAX*32)
#define PIT_MIN32 (Word16)(G729EV_G729_PIT_MIN*32)
void
G729EV_FEC_pitch_pred (
  Word16 bfi,          /* i: Bad frame ?                    */
  Word16 *T,           /* i/o: Pitch                        */
  Word16 *T_fr,        /* i/o: fractionnal pitch            */
                 Word16 *pit_mem,    /* i/o: Pitch memories          */
  Word16 *bfi_mem      /* i/o: Memory of bad frame indicator */
)
{
 Word16 pit, a, b, sum0, sum1;
 Word32 L_tmp;
 Word16 tmp;
 Word16 i;
 /*-----------------------------------------------------------*/
 IF (bfi != 0)
 {
   /* Correct pitch */
   IF(*bfi_mem == 0)
   {
    FOR(i = 3; i >= 0; i--)
    {
     IF(abs_s(sub(pit_mem[i], pit_mem[i + 1]))>128)
     {
      pit_mem[i] = pit_mem[i +1]; move16( );
     }
    }
   }
   /* Linear prediction (estimation) of pitch */
   sum0 = 0; move16( );
   L_tmp = 0; move32( );
   FOR(i= 0; i<5; i++)
   {
     sum0 = add(sum0, pit_mem[i]);
     L_tmp = L_mac(L_tmp, i, pit_mem[i]);
   }
   sum1 = extract_1(L_shr(L_tmp, 2));
   a = sub(mult_r(19661,sum0), mult_r(13107, sum1));
   b = sub(sum1, sum0);
   pit = add(a, b);
   move16( );
   if (sub(pit,PIT_MAX32) > 0)
     pit = PIT_MAX32;
   if (sub(pit,PIT_MIN32) < 0)
     pit = PIT_MIN32;
```

APPENDIX A-continued

```
  *T = shr(add(pit, 16), 5);     move16( );
        tmp = shl(*T, 5);
        IF(sub(pit,tmp) >= 0)
  {
            *T__fr = mult__r(sub(pit, tmp), 3072);        move16( );
  }
        ELSE
  {
            *T__fr = negate(mult__r(sub(tmp, pit), 3072));        move16( );
  }
 }
 ELSE
 {
    pit = add(shl(*T, 5), mult__r(shl(*T__fr, 4), 21845));
 }
 /* Update memory */
 FOR(i = 0; i < 4; i++)
 {
    pit__mem[i] = pit__mem[i + 1];        move16( );
 }
 pit__mem[4] = pit;    move16( );
 *bfi__mem = bfi;      move16( );
/*-----------------------------------------------------------*/
 return;
}
```

APPENDIX B

```
/*****************************************************************************/
/*****************************************************************************/
/*                                Floating-Point Pitch Prediction                                */
/*****************************************************************************/
/*****************************************************************************/
/*-----------------------------------------------------------*
 *    Pitch prediction for frame erasure                    *
 *-----------------------------------------------------------*/
 void
 G729EV__VA__FEC__pitch__pred (
   INT16 bfi,                /* i: Bad frame ?                    */
   INT32 *T,                 /* i/o: Pitch                        */
   INT32 *T__fr,             /* i/o: fractionnal pitch            */
   REAL *pit__mem,           /* i/o: Pitch memories               */
   INT16 *bfi__mem           /* i/o: Memory of bad frame indicator */
 )
 {
  REAL pit, a, b, sum0, sum1;
  INT16 i;
  /*-----------------------------------------------------------*/
   if (bfi != 0)
   {
      /* Correct pitch */
      if (*bfi__mem == 0)
         for (i = 3; i >= 0; i--)
            if (fabs (pit__mem[i] - pit__mem[i + 1]) > 4)
               pit__mem[i] = pit__mem[i + 1];
      /* Linear prediction (estimation) of pitch */
      sum0 = 0;
      sum1 = 0;
      for (i = 0; i < 5; i++)
      {
         sum0 += pit__mem[i];
         sum1 += i * pit__mem[i];
      }
      a = (3.f* sum0 - sum1)/5.f;
      b = (sum1 - 2.f* sum0)/10.f;
      pit = a + b * 5.f;
   if (pit > G729EV__G729__PIT__MAX)
      pit = G729EV__G729__PIT__MAX;
   if (pit < G729EV__G729__PIT__MIN)
      pit = G729EV__G729__PIT__MIN;
   *T = (int) (pit + 0.5f); /*rounding */
   if (pit >= *T)
      *T__fr = (int) ((pit - *T) * 3.f + 0.5f);
   else
      *T__fr = (int) ((pit - *T) * 3.f + 0.5f);
  }
```

APPENDIX B-continued

```
 else
   pit = *T + *T__fr/3.0f;
 /* Update memory */
 for (i = 0; i < 4; i++)
   pit__mem[i] = pit__mem[i + 1];
 pit__mem[4] = pit;
 *bfi__mem = bfi;
 /*-----------------------------------------------------------*/
return;
}
```

What is claimed is:

1. A pitch lag prediction method for use by a speech decoder to generate a predicted pitch lag parameter, the pitch lag prediction method comprising:

generating a first summation based on a plurality of previous pitch lag parameters, from previously received speech frames by the speech decoder, wherein the first summation is defined by $$\text{sum}0 = \sum_{i=0}^{n-1} P(i),$$

where n is the number of the plurality of previous pitch lag parameters defined by P(i);

generating a second summation based on the plurality of previous pitch lag parameters and a position of each of the plurality of previous pitch lag parameters with respect to the predicted pitch lag parameter, wherein the second summation is defined by $$sum1 = \sum_{i=0}^{n-1} i * P(i);$$

calculating a first coefficient using a first equation based on the first summation and the second summation, wherein the first equation is defined by a=(3*sum0−sum1)/5;

calculating a second coefficient using a second equation based on the first summation and the second summation, wherein the second equation is defined by b=(sum1−2*sum0)/10;

predicting the predicted pitch lag parameter based on the first coefficient and the second coefficient; and generating a decoded speech signal using the predicted pitch lag parameter.

2. The pitch lag prediction method of claim 1, wherein the predicting includes generating the predicted pitch lag parameter by adding the first coefficient to a result of the second coefficient multiplied by n.

3. The pitch lag prediction method of claim 1, wherein the first equation and the second equation are obtained by setting $$\frac{\partial E}{\partial a} \text{ and } \frac{\partial E}{\partial b}$$

to zero, where P'(i) defines the predicted pitch lag parameter and where:

$$E = \sum_{i=0}^{n-1} [(P'(i) - P(i)]^2 = \sum_{i=0}^{n-1} [(a + b * i) - P(i)]^2.$$

4. The pitch lag prediction method of claim 3, wherein the predicting includes generating the predicted pitch lag parameter by adding the first coefficient to a result of the second coefficient multiplied by n.

* * * * *